US005989004A

United States Patent [19]

Cook

[11] Patent Number: 5,989,004

[45] **Date of Patent: *Nov. 23, 1999**

[54] FIBER SPIN PACK

[75] Inventor: Michael Charles Cook, Marietta, Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/955,719

[22] Filed: Oct. 22, 1997

Related U.S. Application Data

[63] Continuation of application No. 08/550,042, Oct. 30, 1995, abandoned.

[51] Int. Cl.[6] ..... D01D 5/30

[52] U.S. Cl. ..... 425/131.5; 29/428; 29/527.1; 264/172.11; 425/192 S; 425/382.2; 425/463

[58] Field of Search ..... 425/378.2, 131.5, 425/72.2, 192 S, 382.2, 197, 198, 463; 264/172.11, 173.18, 132, 401; 29/428, 527.1

[56] References Cited

U.S. PATENT DOCUMENTS

| | | | |
|---|---|---|---|
| 3,332,858 | 7/1967 | Bittinger | 204/11 |
| 3,382,534 | 5/1968 | Veazey | 264/172.11 |
| 3,536,007 | 10/1970 | Harvey | 264/132 |
| 3,613,173 | 10/1971 | Matsui et al. | 264/172.11 |
| 3,700,545 | 10/1972 | Matsui et al. | 264/172.11 |
| 3,703,450 | 11/1972 | Bakewell | 204/11 |
| 3,780,149 | 12/1973 | Keuchel et al. | 264/168 |
| 3,787,162 | 1/1974 | Cheetham | 425/463 |
| 4,293,513 | 10/1981 | Langley et al. | 264/132 |
| 4,406,850 | 9/1983 | Hills | 264/171 |
| 4,411,852 | 10/1983 | Bromley et al. | 264/171 |
| 4,436,591 | 3/1984 | de Hek | 204/11 |
| 4,565,616 | 1/1986 | Kenworthy et al. | 204/192 C |
| 4,694,548 | 9/1987 | Ehrfeld et al. | 29/157 C |
| 4,762,595 | 8/1988 | Postupack et al. | 204/11 |
| 4,902,386 | 2/1990 | Herbert et al. | 204/9 |
| 4,954,225 | 9/1990 | Bakewell | 204/11 |
| 5,047,114 | 9/1991 | Frisch et al. | 156/630 |
| 5,162,074 | 11/1992 | Hills | 156/644 |
| 5,183,598 | 2/1993 | Hellé et al. | 264/401 |
| 5,302,421 | 4/1994 | Hoessel et al. | 427/552 |
| 5,344,297 | 9/1994 | Hills | 425/131.5 |
| 5,364,277 | 11/1994 | Crumly et al. | 439/67 |
| 5,393,219 | 2/1995 | Hagen et al. | 264/173.18 |
| 5,443,713 | 8/1995 | Hindman | 205/70 |
| 5,466,410 | 11/1995 | Hills | 264/172.11 |
| 5,562,930 | 10/1996 | Hills | 425/131.5 |

OTHER PUBLICATIONS

J. Ph. Van Delft et al. "Electroforming of Perforated Products", Transactions of the Institute of Metal Finishing, vol. 53, 1975, pp. 178–183.

*Primary Examiner*—James P. Mackey
*Attorney, Agent, or Firm*—Douglas H. Tulley, Jr.; Michael U. Lee

[57] ABSTRACT

There is provided in accordance with the present invention a spin pack for filaments that contains one or more electroformed plates. The invention additionally provides a process for producing a plate for a spin pack, which process has the step of electroforming the plate.

19 Claims, 4 Drawing Sheets

FIBER SPIN PACK

This application is a continuation of application Ser. No. 08/550,042 entitled "IMPROVED FIBER SPIN PACK" and filed in the U.S. Patent and Trademark Office on Oct. 30, 1995, now abandoned. The entirety of this Application is hereby incorporated by reference.

BACKGROUND OF THE INVENTION

The present invention is related to a spin pack. More specifically, the present invention is related to a spin pack containing one or more electroformed plates.

Spin packs for manufacturing fiber from melt-process or solution-processed polymers are well known in the art. A monocomponent fiber spin pack receives a flowably processed stream of a polymer or a blend of polymers and distributes the polymer stream to the spin holes to form a multitude of filaments. A multicomponent conjugate fiber spin pack contains a more complicated distribution system that separately distributes the streams of the component polymers in predetermined positions into the spinning holes to form unitary filaments from each hole.

In general, a spin pack is designed to have a number of modular sections or plates such that the spin pack can be easily cleaned and each plate can be replaced with a new or different plate. Conventionally, the sections or plates of a spin pack are metal articles that are individually precision milled or cut from a metal block to have various channels and bores. Consequently, the production of a spin pack is highly laborious and costly, and it is highly laborious and difficult to produce exact duplicates of a spin pack or plates of a spin pack.

Producing a spin pack for multicomponent conjugate filaments exacerbates the cost and reproducibility problem since a conjugate filament spin pack requires a complicated distribution design that allows precise distribution of different streams of flowably processed polymer compositions throughout the spin pack without allowing intermixing of the streams.

There have been attempts to find less costly methods for producing spin pack plates. One example of such attempts uses a photo-chemical etching process to produce plates for a spin pack. Although the cost of producing etched plates is relatively lower than milled plates, a chemical etching process is not as accurate as a milling process, and thus, the etching production process does not eliminate the reproducibility problem.

There remains a need for a spin pack production process that is less costly and yet highly precise and reproducible.

SUMMARY OF THE INVENTION

The present invention provides a spin pack for filaments that contains a distribution plate and a spinneret plate, wherein the distribution plate is an electroformed plate. The invention additionally provides a process for producing a plate for a spin pack, which process has the step of electroforming the plate. Desirably, the electroforming step is a photoelectroforming step that has the steps of providing a photoresist coated conductive surface and a photomask, wherein the photomask contains a pattern of a plate configuration; placing the photomask over the photoresist coated surface; exposing actinic radiation for an effective duration over the photomask to form exposed regions and unexposed regions; developing the photoresist on the photoresist coated surface; removing exposed or unexposed regions from the coated surface to form a removed pattern containing conductive surface; placing the removed pattern containing surface in an electroforming apparatus; electroforming a plate on the pattern containing surface; and removing the electroformed plate from the pattern containing surface.

The spin pack, more specifically the plates of the pack, of the present invention is highly reproducible and easily produced as well as highly economical.

The term "conjugate fibers" refers to fibers containing at least two polymeric components which are arranged to occupy distinct sections for substantially the entire length of the fibers. The conjugate fibers are formed by simultaneously extruding at least two molten polymeric component compositions as a plurality of unitary multicomponent filaments or fibers from a plurality of capillaries of a spinneret. The terms "fibers" and "filaments" are interchangeably used herein to indicate polymeric fiber strands formed by a spin pack, unless otherwise indicated.

DETAILED DESCRIPTION OF THE INVENTION

Figure 1:
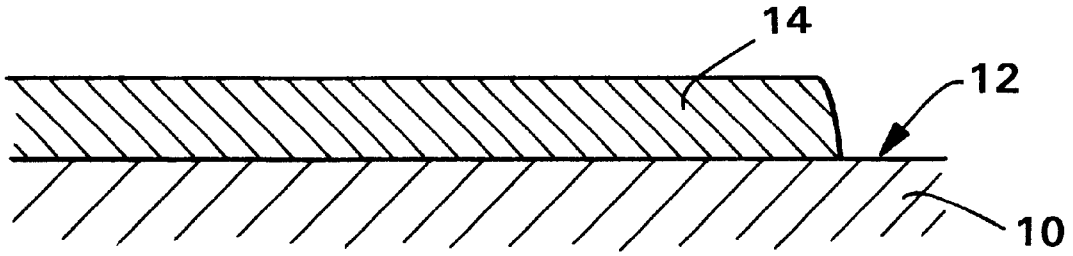
FIG. 1 illustrates a photoresist coated conductive surface.

There is provided in accordance with the present invention a spin pack for producing filaments from flowably processed polymers. The present spin pack is particularly suitable for producing multicomponent conjugate filaments that contain more than one polymer components. The spin pack of the present invention can be used to produce a wide variety of fiber configurations. Exemplary fiber configurations that can be produced with the present spin pack include various conjugate fiber configurations, e.g., side-by-side, concentric sheath-core, eccentric sheath-core, island-in-sea and multisegemented pie configurations; and various cross-sectional fiber shapes, e.g., round, oval, rectangular, multilobal and ribbon shapes. In addition, the spin pack can be used in various fiber forming processes including spunbond, meltblown, textile and staple fiber-forming processes, and can be adapted to different methods for flowably processing the component polymers including melt-processing methods and solution-processing methods.

The spin pack of the present invention contains one or more plates that are electroformed such that the plates are precisely and reproducibly produced. In addition, the cost of producing the plates is significantly lower than conventional machined or milled plates. The combination of reproducibility and low cost of the present plates allows the plates to be disposable, should such a practice is desired. It has been theoretically known that utilizing disposable plates in spin packs is highly desirable since it is highly laborious and costly to cleaning spin pack plates, and thus, it can be highly desirable to utilize disposable spin pack plates. However, in order to take advantage of the disposable concept, the cost of spin pack plates has to be low enough to make economical sense and precise duplicates of spin pack plates must be available. Heretofore, it has not been highly practical to use disposable spin pack plates since it has not been feasible to economically produce precise duplicates of spin pack plates. As stated above, the electroformed plates of the present invention are low-cost and precisely reproducible plates that make the disposable concept highly practical. In general, a spin pack contains a top plate, a screen or filter support plate and a spin plate. However, a spin pack may further contain other plates, e.g., distribution plates, when the pack is designed to produce fibers having a complicated configuration. For example, a spin pack for multicomponent conjugate fibers contains a top plate, a screen or filter support plate, one or more distribution plates and a spin plate. The top plate receives a flowably processed polymer composition or flowably processed polymer compositions and conveys the polymer compositions to the screen support plate. The screen support plate, which contains separate channels for the flowably processed polymer compositions, filters the polymer compositions and feeds the polymer compositions to the spin plate or to the distribution plate if the spin pack contains distribution plates. In a conjugate fiber spin pack, which contains distribution plates, the polymer compositions exiting the screen support plate are channeled through the distribution plates and accurately distributed and positioned to form a desired fiber configuration. The properly distributed polymer compositions are then fed into the spin plate in which the compositions are joined to form a unitary filament.

In accordance with the present invention, plates for spin packs, particularly distribution plates, are electroformed. Desirably, the plates are photoelectroformed. Photoelectroforming, which is an extension of electroplating, is known in the art. A typical photoelectroforming process contains the steps of coating a layer of photoresist on a conductive flat surface of an object; placing a photomask, which contains a photographic image of a desired pattern, over the photoresist layer; exposing the photoresist layer with actinic radiation through the photomask; developing the photoresist layer; removing the actinic radiation exposed or unexposed regions of the photoresist, thereby selectively uncovering regions of the conductive surface to match the positive or negative pattern of the photomask; placing the object, which contains a patterned coating of photoresist, in an electroforming apparatus; depositing metal on the uncovered regions to a desired thickness to form a metal article; and separating the metal article, which is patterned according to the photomask, from the conductive surface.

FIG. 1 illustrates an exemplary photoelectroforming process suitable for the present invention. A photoelectroforming process begins with an object 10, desirably a sheet, having a highly polished, electrically conductive flat surface 12. The object can be an electrically conductive material, e.g., a metal sheet, or a dielectric material, e.g., a nonconductive plastic sheet, plastic film or glass plate, that is conductively modified. When a dielectric material is employed, a layer of electrically conductive material needs to be coated or deposited on the flat surface. Any conventional metal coating technique, such as vacuum deposition, sputtering, chemical vapor deposition or pyrolytic coating process, can be used to form the conductive surface on the dielectric material. Desirably, a sputtering process is used to deposit an even layer of conductive material, such as indium, chrome or copper, to form the conductive surface 12. On the conductive surface 12, an even layer of photoresist 14, e.g., AZ1518 by Hoechst, is applied, and then the photoresist layer is cured to form an electrically nonconductive surface.

Separately, a photomask or photonegative is photographically prepared from a master pattern, e.g., a CAD (computer aided drawing), of a spin pack plate. For example, a photomask is formed by projecting a photographic pattern of a plate onto a silver halide coated transparent sheet and then developing the sheet to form an exact image of the pattern. The developed photomask has a pattern of actinic radiation transparent and opaque regions.

The photomask is placed over the above-described photoresist coated surface 14, and then actinic radiation is applied on the photoresist layer through the photomask, thereby creating a pattern of exposed and unexposed photoresist regions that precisely duplicate the pattern of the photomask. The photoresist layer is developed with a solvent that removes the unexposed portions of the photoresist, and thus, a pattern of conductive regions, which corresponds to the pattern of the photomask and are separated by the remaining photoresist on the conductive surface, are formed. Alternatively, a solvent system that removes the exposed regions of the photoresist can be employed to form a negative image or pattern of the photomask.

Figure 2:
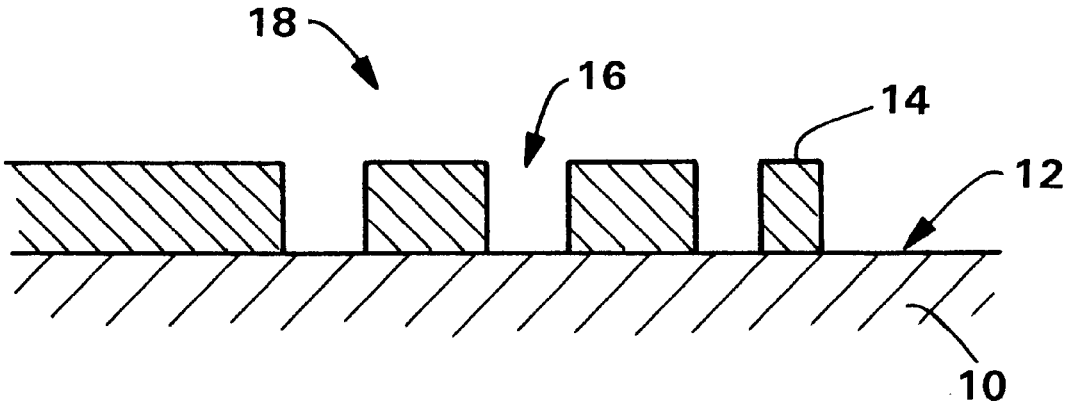
FIG. 2 illustrates a pattern containing photoresist coated surface.
Figure 3:
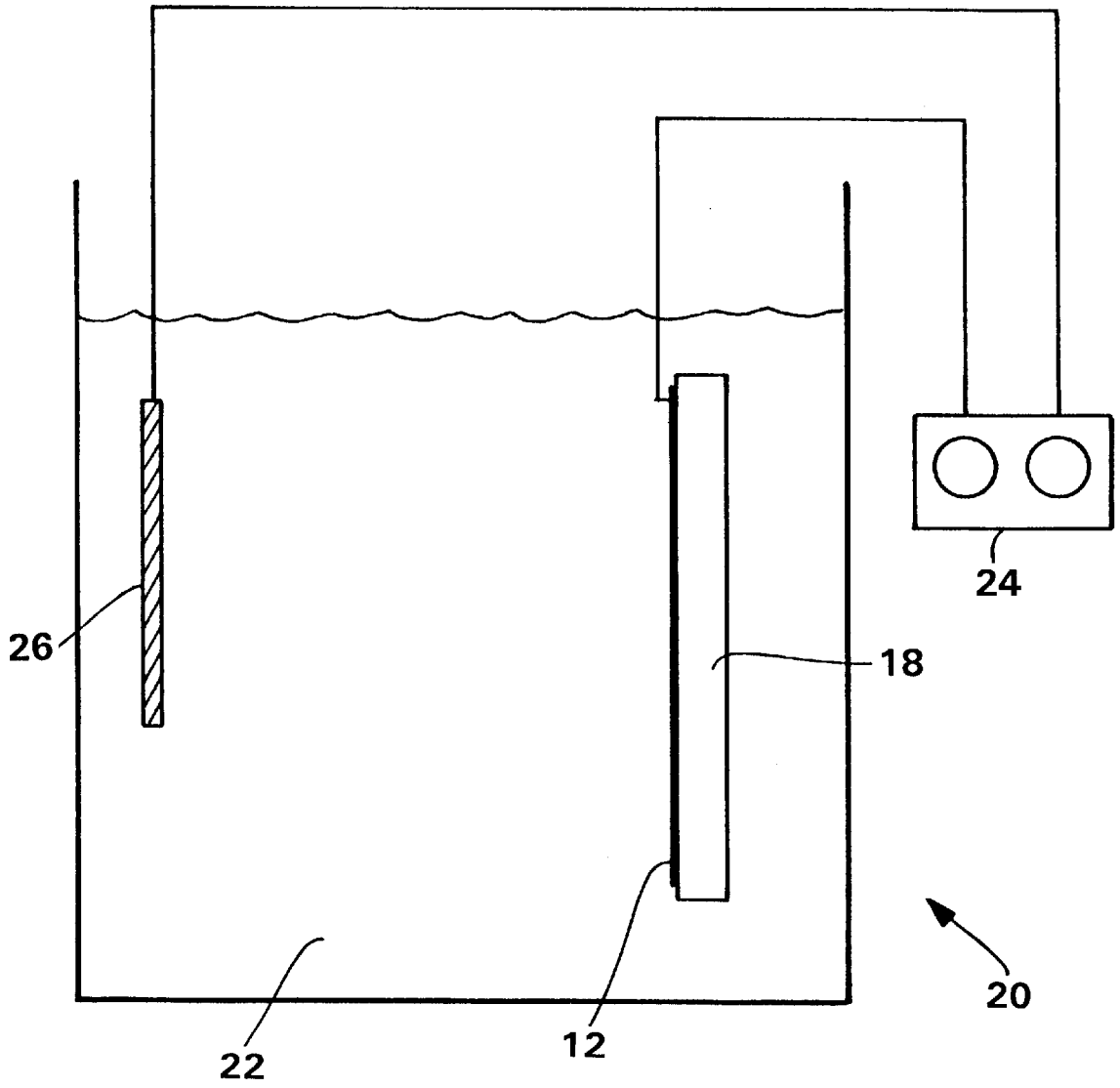
FIG. 3 illustrates a electroforming apparatus suitable for the present invention.

The patterned photoresist-containing object or mandrel 18, FIG. 2, is then placed in a electroforming apparatus 20, FIG. 3, which contains a conventional metal-containing electrodeposition solution 22 and is wired to a DC power source 24. The conductive surface 12 of the mandrel 18 is connected as a cathode and a metal electrode 26 is connected as an anode. The metal electrode 26 supplies the metal ion which is deposited on the conductive surface of the mandrel 18 to form a plate according to the pattern formed by the photoresist. A number of different hard metals and corresponding electroforming solutions that are known to be suitable for conventional electroplating or electroforming operations can be used. For example, a nickel plate can be formed by using a nickel electrode and a electroforming solution containing 300 to 450 g of nickel sulfamate, 0 to 10 g of nickel chloride and 30 to 45 g of boric acid per liter of water. Other metals suitable for the electroforming process of the present invention include chromium, brass, copper, silver, gold, tin and steel.

Figure 4:
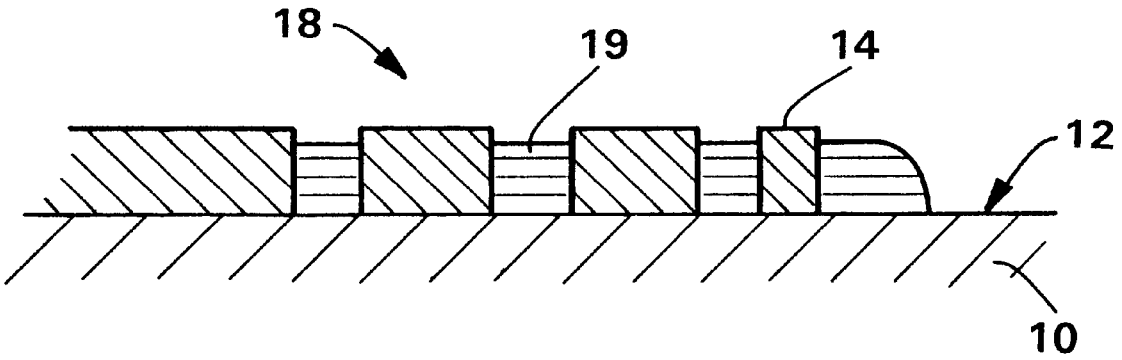
FIG. 4 illustrates a electroformed article on a photoresist coated surface.

During the electroforming operation, the mandrel 18 receives and accumulates metal ions only in the regions 16, as shown in FIG. 2, in which the photoresist is removed and the conductive surface is exposed. The electroforming operation is continued until the electroformed plate attains a desired level of thickness. As is known in the electroforming art, the electroformed plates may be produced to different levels of thickness. In accordance with the above-described disposable plate concept, particularly desirable plates for the disposable concept have a thickness between about 0.002 inches (0.05 mm) and about 0.05 inches (1.3 mm), more desirably between about 0.004 inches (0.1 mm) and about 0.02 inches (0.5 mm). The mandrel 18 is then removed from the electrodeposition solution, and the electroformed plate 19, as shown in FIG. 4, is separated from the mandrel 18. Separation of the plate from the mandrel may be effected by various known means, such as alternatingly heating and chilling the mandrel or dissolving the mandrel.

Although the electroforming process of the present invention is described above with a photoelectroforming process, the process for producing a pattern containing conductive surface, i.e., the mandrel forming process, can be achieved by other equivalent means. For example, a nonconductive material, e.g., a polymeric film, can be mechanically cut with a blade or chemically etched or electromechanically cut with a laser beam to have a desired pattern of nonconductive regions. The patterned material is then securely affixed, e.g., adhesively, over the conductive surface to form a pattern containing laminate mandrel. The mandrel is then subjected to a electroforming process, such as the above described process, to produce a electroformed plate.

Figure 5:
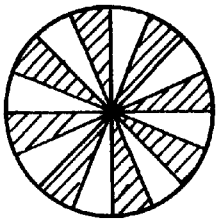
FIG. 5 illustrates an example of a conjugate fiber configuration that can be produced according to the present invention.
Figure 6:
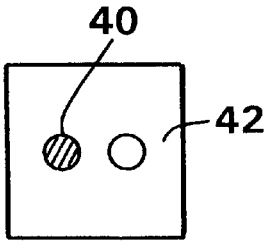
FIGS. 6–12 illustrate electroformed distribution plates used to produce the conjugate fiber of FIG. 5.
Figure 7:
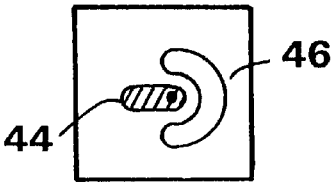
Figure 8:
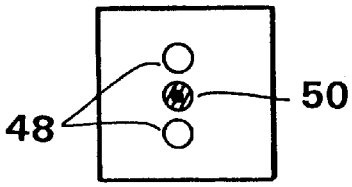
Figure 9:
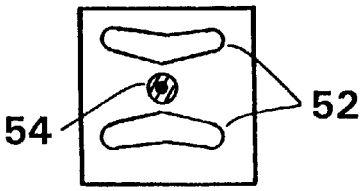
Figure 10:
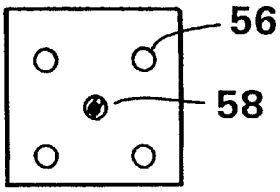
Figure 11:
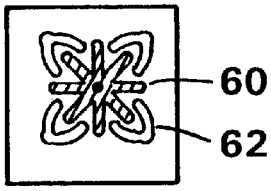
Figure 12:
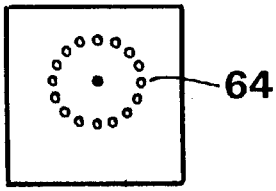

In accordance with the present invention, in a spin pack, there can be more than one distribution plates that are abuttingly stacked to provide desired distribution channels which evenly distributes proper amounts of flowably processed polymer compositions for fibers. For example, FIG. 5 illustrates a sixteen segment pie bicomponent conjugate fiber that can be produced in accordance with the present invention. FIGS. 6–13 illustrate 8 distribution plates which are stacked in that order to form a complete distribution plate set suitable for producing the above bicomponent fiber. The distribution plates are illustrated with one spinhole that produces one strand of the bicomponent fiber. A first distribution plate, FIG. 6, contains two holes 40 and 42 that separately receive a first flowably processed polymer composition and a second flowably processed polymer composition. A second distribution plate, FIG. 7, contains one elongated horizontal hole 44, which receives the first polymer composition from the left end and passes the composition to the right end of the hole, and an outer semicircular hole 46, which receives the second polymer composition at the center and passes the composition to the two ends of the semicircular hole 46. The second distribution plate is followed by a third distribution plate, FIG. 8, that contains two outer holes 48, which are aligned with the two ends of the semicircular hole 46 of the second plate, and a third-plate center hole 50, which is aligned at the right end of the elongated horizontal hole 44 of the second plate. The polymer compositions exiting the third plate is then passed onto a fourth plate, FIG. 9. The forth plate contains two outer elongated holes 52, the centers of which are aligned with the outer holes 48 of the third plate, and a fourth-plate center hole 54, which is aligned with the third-plate center hole 50. The four tips of the two outer elongated holes 52 are aligned with four outer holes 56 of a fifth plate, FIG. 10, thereby providing equal amounts of the second polymer composition to the four outer holes 56. The fifth plate 10 also contains a fifth-plate center hole 58 that receives the first polymer composition from the fourth-plate center hole 54. The sixth plate, FIG. 11, contains a star shaped hole 60 having eight tips and four "V"-shaped holes 62. The eight ends of the four "V"-shaped holes 62 are placed to occupy the eight spaces formed between the tips of the star shaped hole 60, thereby the tips of the star shaped hole 60 and the ends of the "V"-shaped holes 62 are alternatingly aligned in concentrical manner. The four outer holes 56 of the fifth plate are placed directly over the center of the four "V"-shaped holes 62, and the fifth-plate center hole is placed at the center of the star shaped hole 60. The seventh plate contains sixteen concentrically placed holes 64 that are equidistant from each other and are the same size. The sixteen holes 64 are alternatingly placed under the tips of the star shaped hole 60 and the ends of the "V"-shaped holes 62. Consequently, the sixteen holes 64 alternatingly receive the first and second flowably processed polymer compositions.

The polymer compositions are then passed into the bore of the spin plate in laminar fashion to prevent measurable intermixing of the compositions, and the polymer compositions are merged into a unitary strand containing sixteen segments. The unitary strand is gradually made into a thin strand as it passes through the spin plate bore and exits the spin pack as a small filament that retains the pie shaped sixteen segments.

Figure 13:
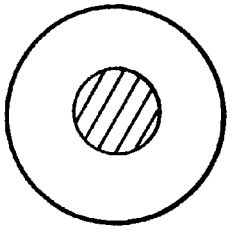
FIG. 13 illustrates another example of a conjugate fiber configuration that can produced according to the present invention.
Figure 14:
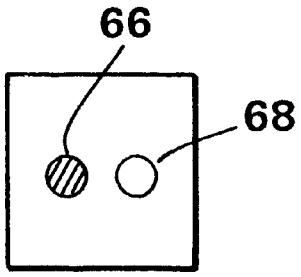
FIGS. 14–17 illustrate electroformed distribution plates used to produce the conjugate fiber of FIG. 13.
Figure 15:
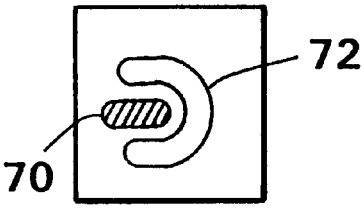
Figure 16:
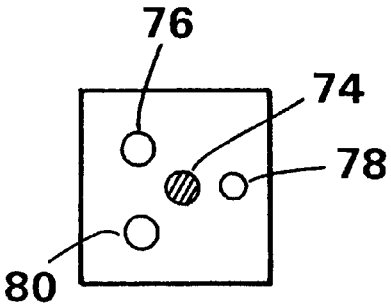
Figure 17:
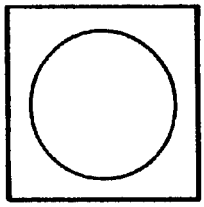

As another example, FIG. 13 illustrates a sheathcore bicomponent fiber that can be produced according to the present invention. The spin pack for the sheath-core conjugate fiber contains four distribution plates. A first distribution plate, FIG. 14, contains a first hole 66 and a second hole 68 that separately receive a first flowably processed polymer composition and a second flowably processed polymer composition, respectively. A second distribution plate, FIG. 15, contains one elongated horizontal hole 70, which receives the first polymer composition from the left end and passes the composition to the right end of the hole 70, and an outer semicircular hole 72, which receives the second polymer composition at the center of the semicircular hole 72. The second plate is followed by a third plate, FIG. 16, which has a central hole 74 and three outer holes, 76, 78 and 80. The central hole 74 is aligned with the right end of the elongated horizontal hole 70. Two of the three outer holes (tip holes), 76 and 80, are aligned with the two outer ends of the semicircular hole 72 of the second plate, and the remaining outer hole (center hole) 78 is placed at the center of the semicircular hole 72. It is to be noted that the center hole 78, which is substantially aligned with the second hole 68 of the first plate through the semicircular hole 72, is smaller than the tip holes 76 and 80. The small size of the center hole 78 prevents a disproportionately large amount of the second flowably processed composition from going through the center hole 78 and evenly or properly distributes the composition to all three outer holes 76, 78 and 80. The polymer compositions exiting the third plate is then passed onto a fourth plate, FIG. 17. The fourth plate contains a large hole that allows the second flowably process composition exiting the three outer holes 76, 78 and 80 to horizontally spread and merge, forming a sheath configuration around the first composition that exits the central hole 74. The compositions are then passed into the bore of the spin plate to form a sheath-core conjugate filament.

Although the present spin pack is illustrated above with two component polymer containing conjugate fibers, the present invention is not limited thereto. The shapes and designs of the channels and holes of the distribution plates can be changed in accordance with various fiber configurations that are sought to be produced. Such changes and designs of the channels and holes of the plates are within general knowledge of one skilled in the spin pack art. In addition, the electroforming process of the present invention can be utilized to produce distribution plates that have varying sizes of distribution holes and, thus, deliver different amounts of flowably processed polymers to different spin holes of the spin plate. A spin pack containing such distribution plates having varying hole sizes can be utilized to produce a nonwoven fabric containing heterogeneous filaments of different sizes. Additionally, the electroformed distribution plates of the present invention can be used in combination with conventionally produced distribution plates, and the electroforming process of the present invention can be used to produce various parts and plates of a spin pack although the invention is described in conjunction with distribution plates.

As indicated above, the present electroforming process for producing the distribution plates is highly precise and reproducible as well as highly economical. Moreover, the present process is highly adaptable for producing fibers having various configurations.

What is claimed is:

1. A spin pack for forming polymeric filaments, comprising a spin plate and a plurality of stacked electroformed distribution plates, said electroformed distribution plates having apertures therein and arranged so that the apertures of adjacent electroformed distribution plates only partially overlap wherein polymer flowing through said stacked distribution plates is channeled laterally and vertically through said spin pack.

2. The spin pack of claim 1 wherein said distribution plates is photoelectroformed.

3. The spin pack of claim 1 wherein said distribution plates comprises nickel, chromium, brass, copper, silver, gold, tin or steel.

4. The spin pack of claim 1 wherein said distribution plate has a thickness between about 0.002 inches and about 0.05 inches.

5. The spin pack of claim 4 wherein said distribution plates has a thickness between about 0.004 inches and 0.02 inches.

6. The spin pack of claim 1 further comprising a top plate and a screen support plate.

7. The spin pack of claim 2 wherein said distribution plate comprises nickel.

8. The spin pack of claim 7 wherein said spin pack is a spin pack for side-by-side, concentric sheath-core, eccentric sheath-core, island-in-sea or multisegemented pie conjugate fibers.

9. The spin pack of claim 2 wherein said distribution plates comprise a metal selected from the group consisting of nickel, chromium, brass, copper, silver, gold, tin and steel.

10. The spin pack of claim 9 wherein said distribution plates have a thickness between about 0.004 inches and 0.05 inches.

11. The spin pack of claim 8 wherein said distribution plates comprise nickel and have a thickness between about 0.004 inches and 0.02 inches.

12. A method of making a spin pack for forming polymeric filaments comprising:

electroforming at least three distribution plates and placing said distribution plates in a stacked, flatwise configuration, said distribution plates being electroformed having apertures therein and arranged so that the apertures of adjacent electroformed distribution plates only partially overlap and wherein molten polymer flowing into the stacked distribution plates from a first distribution plate is channeled laterally and vertically through the stack and exits through a terminal distribution plate;

providing a top plate having a first outlet opening and a second outlet opening and placing said outlet openings in fluid communication with said apertures of said first distribution plate;

providing a spin plate having at least one aperture and placing the at least one aperture of the spin plate in fluid communication with said terminal distribution plate.

13. The method of claim 12 wherein said electroformed plates have a thickness of between about 0.002 inches and about 0.05 inches.

14. The method of claim 13 wherein said distribution plates are photoelectroformed.

15. The method of claim 14 wherein said distribution plates are formed from a metal selected from the group consisting of nickel, chromium, copper, brass, silver, gold, tin and steel.

16. The method of claim 12 wherein electroforming a plurality of distribution plates comprises:

(i) electroforming a first distribution plate having first and second apertures wherein, when said first distribution plate is placed in fluid communication with said top plate, the first aperture of the first distribution plate is in fluid communication with the first outlet opening of the top plate and the second aperture of the first distribution plate is in fluid communication with the second outlet opening of the top plate and wherein no aperture of the first distribution plate is in fluid communication with both the first and second outlet openings of the top plate;

(ii) electroforming at least two medial distribution plates each having at least two apertures wherein at least one aperture in each of the medial distribution plates are in fluid communication with each of said first and second apertures of the first distribution plate and wherein no aperture of the medial distribution plates are in fluid communication with both the first and second apertures of the first distribution plate;

(iii) electroforming a terminal distribution plate having at least one aperture wherein each of said apertures of the medial distribution plates are in fluid communication with said terminal distribution plate.

17. The method of claim 16 wherein said medial distribution plates have at least one elongated aperture.

18. The method of claim 17 wherein said stacked distribution plates are formed having apertures wherein the stacked distribution plates provide a patterned flow of molten polymer to said spin plate for forming multicomponent fibers selected from the group consisting of sheath/core fibers, side-by-side fibers, island-in-sea fibers and multisegmented pie fibers.

19. A spin pack made by the method of claim 18.

* * * * *